US011598209B2

(12) United States Patent
Abrams et al.

(10) Patent No.: US 11,598,209 B2
(45) Date of Patent: Mar. 7, 2023

(54) METHOD FOR BORING WITH PLASMA

(71) Applicant: ArcByt, Inc., Richmond, CA (US)

(72) Inventors: Kimberly Abrams, Richmond, CA (US); Shivani Torres, Richmond, CA (US); Kamyar Mosavat, Richmond, CA (US); Barzin Moridian, Richmond, CA (US); Artem Tkachenko, Richmond, CA (US); Matthew Strangeway, Richmond, CA (US); Molly Dicke, Richmond, CA (US); Arielle Dobrowolski, Richmond, CA (US); Randy Link, Richmond, CA (US); Nimit Baid, Richmond, CA (US)

(73) Assignee: ArcByt, Inc., San Francisco, CA (US)

( * ) Notice: Subject to any disclaimer, the term of this patent is extended or adjusted under 35 U.S.C. 154(b) by 0 days.

(21) Appl. No.: 17/471,871

(22) Filed: Sep. 10, 2021

(65) Prior Publication Data

US 2022/0082017 A1 Mar. 17, 2022

Related U.S. Application Data

(60) Provisional application No. 63/077,539, filed on Sep. 11, 2020.

(51) Int. Cl.
*E21D 9/10* (2006.01)
*E21B 7/14* (2006.01)
(Continued)

(52) U.S. Cl.
CPC ..... *E21D 9/1073* (2013.01); *E21B 7/14* (2013.01); *E21C 35/24* (2013.01); *E21C 37/16* (2013.01);
(Continued)

(58) Field of Classification Search
CPC ..... E21D 9/1073; E21D 9/003; E21D 9/108; E21D 9/1013; E21D 9/102; E21D 9/1026;
(Continued)

(56) References Cited

U.S. PATENT DOCUMENTS 3,788,703 A * 1/1974 Thorpe ..... E21C 37/16 299/14
2009/0212216 A1* 8/2009 Hargrave ..... E21C 35/08 299/1.1
(Continued)

FOREIGN PATENT DOCUMENTS

CN 111163545 A * 5/2020
DE 102011103282 A1 * 12/2012 ..... B23K 26/032

OTHER PUBLICATIONS

Machine Translation of Lesmuller DE-102011103282-A1, Dec. 2012, 8 pages (Year: 2012).*

*Primary Examiner* — Abby J Flynn
*Assistant Examiner* — Michael A Goodwin
(74) *Attorney, Agent, or Firm* — Polygon IP, LLP

(57) ABSTRACT

Systems to bore or tunnel through various geologies in an autonomous or substantially autonomous manner can include one or more non-contact boring elements that direct energy at the bore face to remove material from the bore face through fracture, spallation, and removal of the material. The systems can automatically execute methods to control a set of boring parameters that affect the flux of energy directed at the bore face. Systems can further automatically execute the methods to trigger an optical sensor to capture images at the bore face, generate temperature profiles, identify spall fragments and hot zones and/or adjust a set of boring controls. For example, the system can execute methods to adjust a standoff distance between the system and the bore face, and adjust power and/or gas supply to the non-contact boring element.

20 Claims, 5 Drawing Sheets

(51) Int. Cl.

| | |
|---|---|
| ***E21C 37/16*** | (2006.01) |
| ***E21C 35/24*** | (2006.01) |
| ***E21D 9/00*** | (2006.01) |
| *E21C 37/18* | (2006.01) |

(52) U.S. Cl.
CPC ..... *E21D 9/003* (2013.01); *E21D 9/108* (2013.01); *E21C 37/18* (2013.01)

(58) Field of Classification Search
CPC ..... E21D 9/1033; E21C 37/26; E21C 35/24; E21C 37/16; E21C 37/18; E21C 39/00; E21B 7/14; E21B 7/15; E21B 43/281; E21B 43/285
See application file for complete search history.

(56) References Cited

U.S. PATENT DOCUMENTS

| | | | | |
|---|---|---|---|---|
| 2014/0231398 | A1* | 8/2014 | Land | E21C 37/16 219/121.72 |
| 2017/0297140 | A1* | 10/2017 | Taminger | B23K 15/06 |
| 2019/0085688 | A1* | 3/2019 | Helming | E21B 7/15 |

* cited by examiner

METHOD FOR BORING WITH PLASMA

CROSS-REFERENCE TO RELATED APPLICATIONS

This Applications claims benefit of U.S. Provisional Application No. 63/077,539, filed on 11 Sep. 2020, which is hereby incorporated in its entirety by this reference.

TECHNICAL FIELD

The invention relates generally to the field of underground boring and more specifically to a new and useful method for underground boring with plasma in the field of underground boring.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Method

Figure 1:
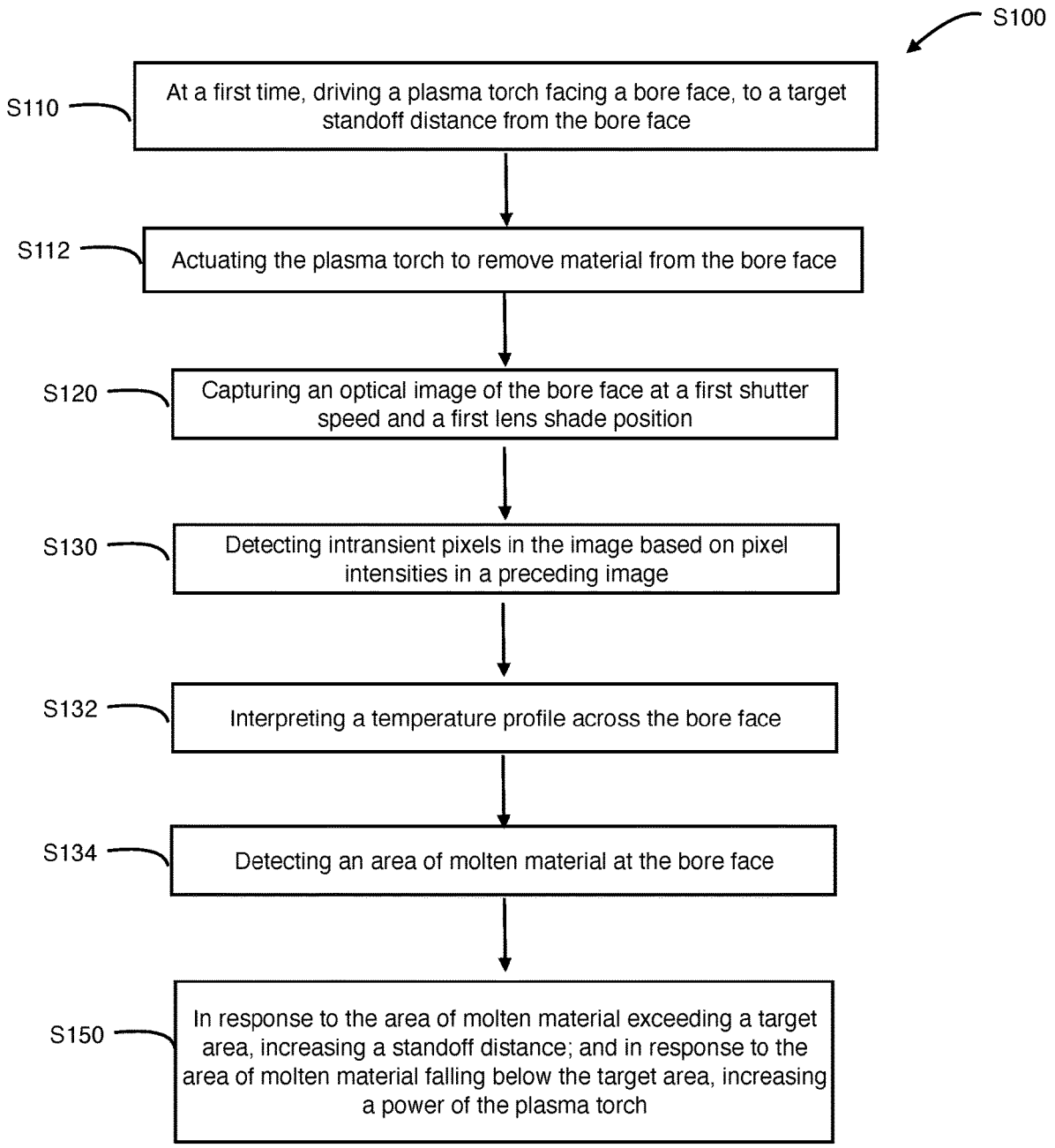
FIG. 1 is a flow chart of an example implementation of a method for boring with a non-contact boring element.

As shown in FIG. 1, a method S100 for underground boring with plasma includes: at a first time, driving a plasma torch 132, facing a bore face 200, to target standoff distance from the bore face 200 in Block S110; actuating the plasma torch 132 to remove material from the bore face 200 in Block S112; capturing an optical image of the bore face 200 at a first shutter speed and a first lens shade position in Block S120; detecting intransient pixels in the image based on pixel intensities in a preceding image in Block S130; interpreting a temperature profile across the bore face 200 based on intensities of intransient pixels in the optical image, the first shutter speed, and the first lens shade position in Block S132; detecting an area of molten material at the bore face 200 based on the temperature profile in Block S134; in response to the area of molten material exceeding a target area, increasing a standoff distance between the plasma torch 132 and the bore face 200 in Block S150; and, in response to the area of molten material falling below the target area, increasing a power supply 134 of the plasma torch 132 in Block S150.

Figure 2:
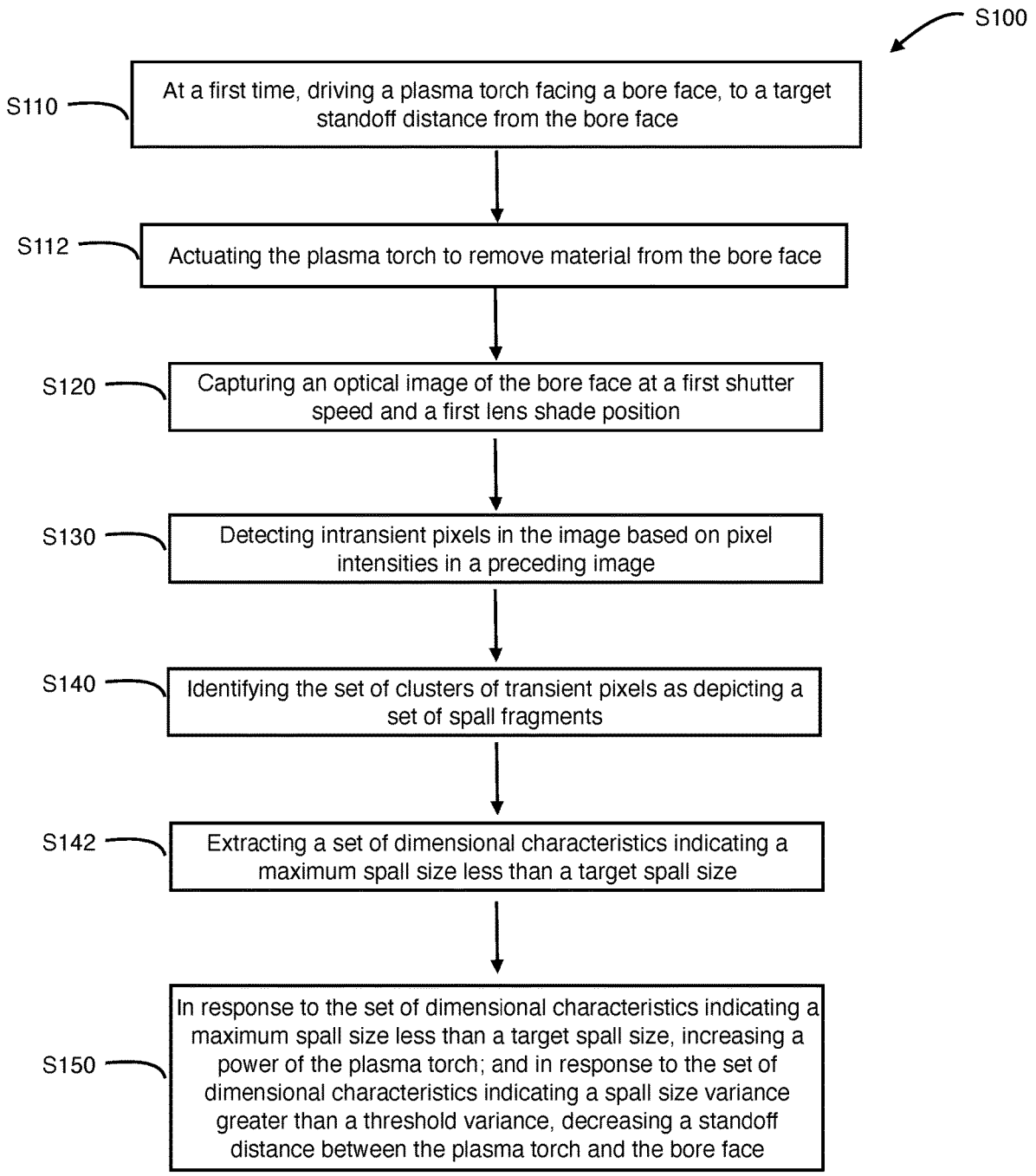
FIG. 2 is a flow chart of another example implementation of a method for boring with a non-contact boring element.

As shown in FIG. 2, one variation of the method S100 includes: at a first time, driving a plasma torch 132, facing a bore face 200, to target standoff distance from the bore face 200 in Block S110; actuating the plasma torch 132 to remove material from the bore face 200 in Block S112; capturing an optical image of the bore face 200 in Block S120; detecting a set of clusters of transient pixels in the image based on pixel intensities in a preceding image in Block S130; identifying the set of clusters of transient pixels as depicting a set of spall fragments 210 in Block S140; extracting a set of dimensional characteristics of the set of spall fragments 210 from the set of clusters of transient pixels in Block S142; in response to the set of dimensional characteristics indicating a maximum spall size less than a target spall size, increasing a power supply 134 of the plasma torch 132 in Block S150; and, in response to the set of dimensional characteristics indicating a spall size variance greater than a threshold variance, decreasing a standoff distance between the plasma torch 132 and the bore face 200 in Block S150.

2. Applications

Generally, the method S100 can be executed by a plasma boring system 100 (hereinafter the "system 100") during a plasma boring operation to modulate plasma torch 132 power, gas flow rate, orientation, standoff distance from the bore face 200, and/or spoil removal subsystems as a function of temperature profile of the bore face 200, presence of molten material on the bore face 200, and/or characteristics (e.g., size, size distribution) of spall fragments 210 discharged from the bore face 200 in order to maintain efficient boring and consistent spoil characteristics.

More specifically, the system 100 can execute Blocks of the method S100 to: distinguish moving spall fragments 210 from the bore face 200 depicted in an image—captured by a non-contact (e.g., optical) sensor in the system 100—based on transience of features from preceding images to the current image; derive a temperature profile of the bore face 200 based on pixel intensities depicting intransient features (e.g., features changing in light intensity on time scales greater than one second) in the current image; and then implement closed-loop controls to adjust power, gas flow rate, standoff distance, and/or orientation of the plasma torch 132 in order to achieve a target temperature profile across the bore face 200 that corresponds to a high rate of material removal and controlled spoil size. Similarly, the system 100 can: distinguish molten from solid regions across the bore face 200 based on pixel intensities depicting intransient features in the current image; and then implement closed-loop controls to adjust power, gas flow rate, standoff distance, and/or orientation of the plasma torch 132 in order to achieve a target proportion or area of molten material across the bore, such as to form a vitreous liner (or "magma tube") of nominal thickness along the tunnel with this molten material.

Furthermore, the system 100 can execute Blocks of the method S100 to: distinguish spall fragments 210 from the bore face 200 based on transient features (e.g., features changing in light intensity on time scales less than one second) in the current image; extract dimensional characteristics (e.g., maximum, minimum, average, and distribution of size) of these spall fragments 210 from the current image; and then implement closed-loop controls to adjust power, gas flow rate, and/or standoff distance of the plasma torch 132 based on spall fragment dimensional characteristics derived from the current image in order to achieve a target spall fragment size with minimal variance, thereby increasing market value of this spoil, reducing need for post-processing of this spoil, and simplifying removal of this spoil from the tunnel.

The system 100 can also implement closed-loop controls to adjust actuation of a spoil evacuation subsystem within and/or behind the system 100 based on spall fragment dimensional characteristics derived from the current image in order to ensure evacuation of spoil from a working volume between the system 100 and the bore face 200, thereby reducing need to re-melt (or "re-spallate") this spoil for removal from the tunnel, reducing energy consumption per unit length of the tunnel, and increasing boring speed of the system 100.

The method S100 is described herein as executed by the system 100 during a horizontal boring operation. However, the system 100 can additionally or alternatively execute Blocks of the method S100 during vertical and angled boring operations.

2.1 Geology and Boring Method

Generally, the system 100 executes Blocks of the method S100 while boring through underground geologies with plasma in order to avoid melting rock (e.g., creating magma) and instead maintain spoil in the form of a gas (e.g., gaseous carbonate) with spall fragments 210 (e.g., rock flakes), thereby enabling a spoil evacuator within the system 100 to draw spoil—removed from the bore face 200—rearward and out of the bore with limited spoil entrapment between the system 100 and the bore face 200 and with limited collection of spoil along the spoil evacuator (e.g., due to condensation of molten rock or "slag" on cooler surfaces within the spoil evacuator). (Additionally or alternatively, the system 100 can modulate power, gas flow rate, and/or standoff distances according to Blocks of the method S100 in order to achieve a target rate of magma generation (e.g., a target magma volume creation rate), such as in preparation for applying this magma to the surface of the bore to form a vitreous liner of target thickness and profile along the bore.)

In particular, various geologies may contain crystals (e.g., $SiO_2$) in large proportions, such as sandstone, granite, and basalt. For example, basalt commonly contains 30-40% $SiO_2$ by volume and may contain as much as 80% $SiO_2$ by volume. $SiO_2$ exhibits a relatively low melting temperature. However, the crystalline structure of $SiO_2$ may decompose below the melting temperature of $SiO_2$. Therefore, the system 100 can implement Blocks of the method S100 to control the temperature of material at the bore face 200 near the crystalline decomposition temperature of $SiO_2$—and below the melting temperature of $SiO_2$—in order to decompose the crystalline structure of material across the bore face 200 and to thus fracture (or "disintegrate") this material while not melting this material (or controlling a volume of molten material per unit distance bored by the system 100).

More specifically, the system 100 executes Blocks of the method S100 in order to fracture and disintegrate rock (and soil, etc.) at the bore face 200 before these materials melt. By fracturing material at the face of the bore rather than melting this material, the system 100 can remove less complex spoil (e.g., gas and solid rock spall fragments 210 only rather than gas, spall, and magma) with less heat, which may extend the operating life of components of the system 100 and reduce energy consumption per unit distance or volume bored.

Furthermore, the effectiveness of fracturing material at the bore face 200 (e.g., via thermal shock) may be a function of pressure and heat. To increase pressure at the bore face 200, the system 100 can: decrease the distance from the torch to the bore face 200 (hereinafter "standoff distance) and/or increase gas flow rate through the torch; the system 100 can also increase torch power to compensate for increased gas flow rate. Similarly, to increase temperature at the bore face 200, the system 100 can: decrease bore speed or increase dwell time; decrease the standoff distance; and/or increase torch power.

The method S100 is described herein as executed by the system 100 to bore through felsic geologies containing high proportions of crystals, such as $SiO_2$. However, the system 100 can additionally or alternatively execute Blocks of the method S100 to bore through other igneous, metamorphous, and sedimentary geologies (e.g., intermediate, mafic, and ultramafic geologies; sand, soil, silty sand, clay, cobbles, loam).

Furthermore, the method S100 is described herein as executed by the system 100 to remove material from a bore face 200 via spallation and gasification (or vaporization) while controlling spall fragment dimensional characteristics and minimizing or eliminating melting of material at the bore face 200. However, the system 100 can additionally or alternatively execute Blocks of the method S100 to control a rate or volume of melting of material at the bore face 200, which the system 100 may apply across the surface of the bore to form a vitreous (or "glassified") rock liner of target thickness along the length of the bore.

3. System

Generally, the system 100 includes: a chassis no; a propulsion system 120, such as a set of wheels or tracks driven by an electric, hydraulic, or pneumatic motor; and a plasma torch 132, such as a non-transferred DC torch. The system 100 can also include a torch ram configured: to locate the plasma torch 132 on the chassis no; to advance and retract the torch longitudinally along the chassis no; to tilt the torch in pitch and yaw on the chassis 110 (e.g., by up to +/−5°); and/or to lift the torch vertically and shift the torch laterally on the chassis no.

The system 100 can further include: one or more optical sensors, such as described below; a spoil evacuator configured to draw or force waste (e.g., gas and spall) from between the system 100 and the bore face 200 (hereinafter the "working volume) to a region behind the system 100 and/or out of the bore, such as via an umbilical cord or conventional conveyor; and a power supply 134 and gas supply 136 configured to supply electrical power and pressurized gas to the system 100.

The system 100 further includes a controller 180 configured: to sample the optical sensor 190; to interpret bore face temperature, molten material on the bore face 200, and/or spall fragment dimensional characteristics from images captured by the optical sensor 190; and to modulate power, modulate gas flow rate, control the propulsion system 120, adjust the position of the torch on the chassis no via the torch ram, and control the spoil evacuator according to Blocks of the method S100.

Figure 3:
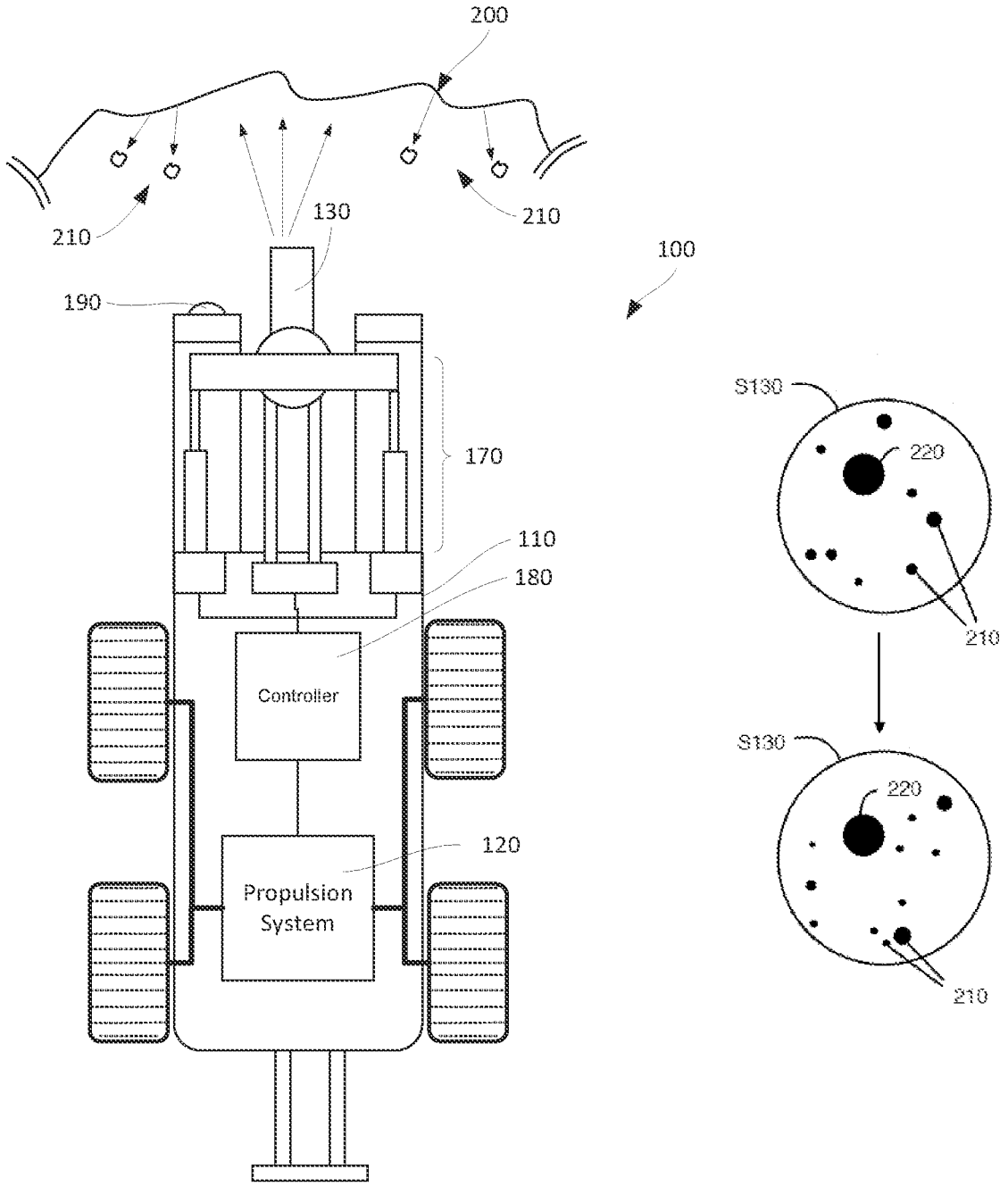
FIG. 3 is a schematic representation of an example implementation of a system for boring with a non-contact boring element.

In one variation of the example implementation shown in FIG. 3, a system 100 for boring with plasma can include a chassis 110; a propulsion system 120 arranged with the chassis 110 to advance the chassis 110 in a first direction toward a bore face 200 and retract the chassis no in a second direction away from the bore face 200; a non-contact boring element 130 connected to the chassis 110 and configured to operate in response to a set of boring parameters; and an optical sensor 190 configured capture images of the bore face 200. The system 100 can also include a controller 180 connected to the propulsion system 120, the non-contact boring element 130, and the optical sensor 190 and configured to control the propulsion system 120, the non-contact boring element 130, and the optical sensor 190, in response to the optical sensor 190 detecting an area of molten material and/or a set of spall fragments 210 at the bore face 200.

Figure 4A:
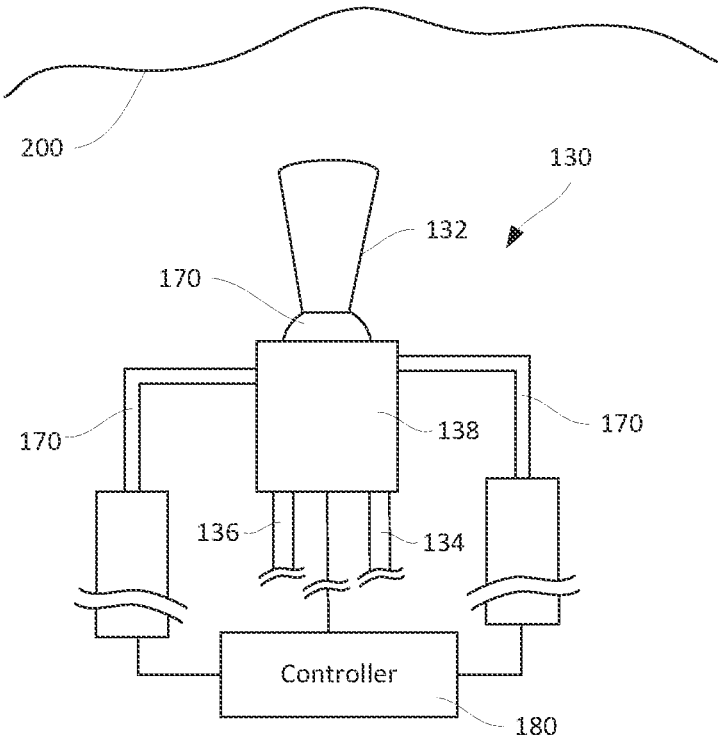
FIG. 4A is a schematic representation of an example implementation of a system for boring with a plasma torch.
Figure 4B:
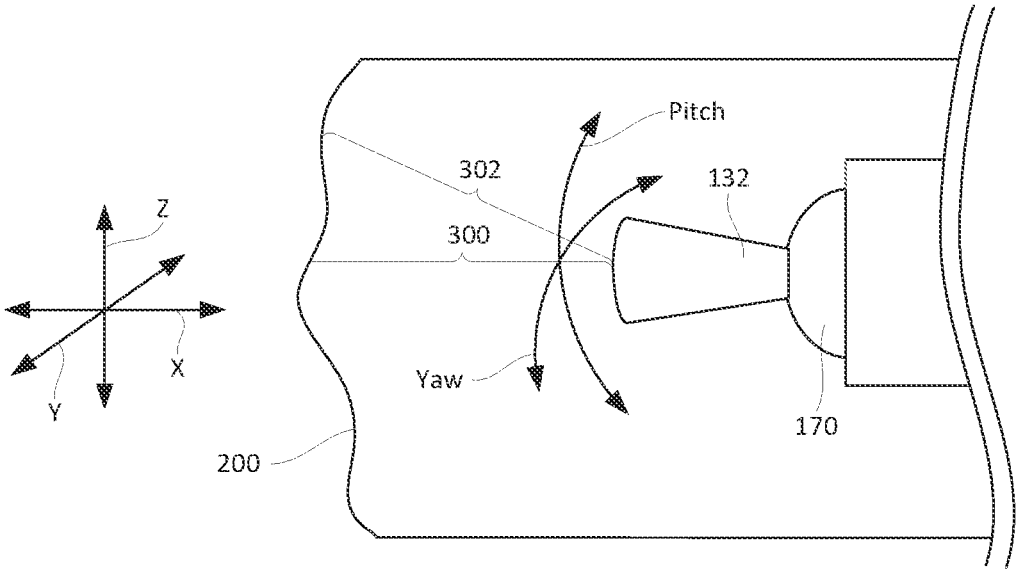
FIG. 4B is a schematic representation of an example implementation of a system for boring with a plasma torch.

In another implementation, shown in FIGS. 4A and 4B, the system 100 can include: a chassis 110; a propulsion system 120 arranged with the chassis 110 to advance the chassis 110 in a first direction toward a bore face 200 and retract the chassis 110 in a second direction away from the bore face 200; a plasma torch 132 connected to a power supply 134 and a gas supply 136; and a plasma torch ram 170 connecting the plasma torch 132 to the chassis 110.

As shown in FIGS. 4A and 4B, the plasma torch ram 170 can be configured to: locate the plasma torch 132 on the chassis 110; advance and retract the plasma torch 132 along the chassis 110 along a longitudinal axis (X-axis) substantially parallel to the first direction and the second direction; tilt the plasma torch 132 along a pitch angle relative to the longitudinal axis and a yaw angle relative to the longitudinal axis, lift the plasma torch 132 vertically along the vertical axis (Z-axis) substantially perpendicular to the longitudinal axis; and shift the plasma torch 132 laterally along a horizontal axis substantially perpendicular to the longitudinal axis and the vertical axis.

As shown in FIGS. 3, 4A, and 4B, the system 100 can also include an optical sensor 190 configured to capture images of the bore face 200; and a spoil evacuator configured to draw waste from a first location between the chassis 110 and the bore face 200 to a second location. In this variation of the example implementation, the system 100 can also include a controller 180 connected to the propulsion system 120, the plasma torch 132, the plasma torch ram 170, and the optical sensor 190 and configured to drive the propulsion system 120, the plasma torch 132, the plasma torch ram 170, and the optical sensor 190 in response to the depth sensor detecting an area of molten material and/or a set of spall fragments 210 at the bore face 200.

Figure 5:
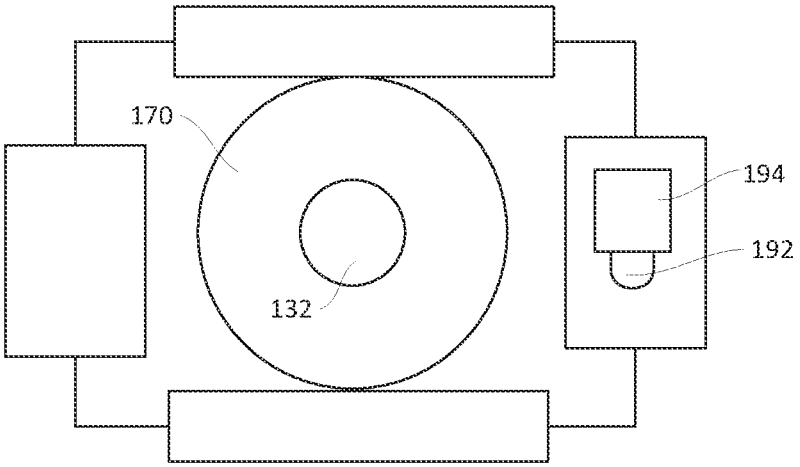
FIG. 5 is a schematic representation of an example implementation of a system for boring with a plasma torch.

In yet another variation of the system 100 shown in FIG. 5, the system 100 can include: a propulsion system 120 arranged with the chassis no to advance the chassis 110 in a first direction toward a bore face 200 and retract the chassis 110 in a second direction away from the bore face 200; a plasma torch 132 connected to a power supply 134 and a gas supply 136; and a plasma torch ram 170 connecting the plasma torch 132 to the chassis 110.

As shown in FIGS. 4A, 4B, and 5 the plasma torch ram 170 can be configured to: locate the plasma torch 132 on the chassis 110; advance and retract the plasma torch 132 along the chassis 110 along a longitudinal axis (X-axis) substantially parallel to the first direction and the second direction; tilt the plasma torch 132 along a pitch angle relative to the longitudinal axis and a yaw angle relative to the longitudinal axis, lift the plasma torch 132 vertically along the vertical axis (Z-axis) substantially perpendicular to the longitudinal axis; and shift the plasma torch 132 laterally along a horizontal axis substantially perpendicular to the longitudinal axis and the vertical axis.

As shown in FIGS. 3, 4A, 4B, and 5 the system 100 can include an optical sensor 190 which can include: a lens shade 192 arranged at a front end of the chassis 110 and directed toward the bore face 200; and a shutter arranged at the front end of the chassis 110 to selectively cover the field of view of the lens shade 192. Additionally, the system 100 can also include a spoil evacuator configured to draw waste from a first location between the chassis 110 and the bore face 200 to a second location. In this variation of the example implementation, the system 100 can also include a controller 180 connected to the propulsion system 120, the plasma torch 132, the plasma torch ram 170, and the optical sensor 190 and configured to drive the propulsion system 120, the plasma torch 132, the plasma torch ram 170, and the optical sensor 190 in response to the optical sensor 190 detecting an area of molten material and/or a set of spall fragments 210 at the bore face 200.

3.1 Optical Sensor

In one implementation, the system 100 includes: a thermally-shielded sensor housing; a thermally-shielded window 194 (e.g., a louvered shutter) arranged across an opening in the sensor housing; and a 2D optical sensor 190 arranged in the sensor housing behind the window 194. For example, the optical sensor 190 can include: an infrared thermal camera; a color (e.g., RGB and/or RGB-D) camera; or an array of infrared or laser single-point temperature sensors, each representing a "pixel." In one variation of this implementation, the system can include a light source or emitter to illuminate the bore face 200 and improve the visualization of the optical sensor 190.

In another variation of this implementation, in addition to the optical sensor 190, the system can include solid state sensors, inertial measurement units, gyroscopes, and magnetometers.

For example, during an imaging cycle, the controller 180 can: trigger the window 194 to open; trigger the optical sensor 190 to capture a burst of images of the bore face 200 (e.g., 30 images over a half-second imaging cycle); and then close the window 194 to shield the optical sensor 190 from excess heat output by the adjacent plasma torch 132 and enable the optical sensor 190 to cool and/or recalibrate in preparation for a next imaging cycle. For example, the controller 180 can intermittently trigger the optical sensor 190 to execute an imaging cycle, such as once per five-second interval or at a 10% duty. Alternatively, the system 100 can include a temperature sensor within the sensor housing. During operation, the controller 180 can: regularly sample this temperature sensor; open the window 194 and trigger the optical sensor 190 to capture images while the temperature in the housing is within an operating temperature range; and close the window 194 and cease operation of the optical sensor 190 when the temperature in the housing exceeds this operating temperature range.

Furthermore, the system 100 can include a lens shade 192—such as a fixed or adjustable UV, infrared, and/or visible light filter—arranged across the field of view of the optical sensor 190. In particular, the lens shade 192 can be configured to prevent overexposure of images captured by the optical sensor 190 and thus enable the system 100 to capture rich optical data of the bore face 200, interpret conditions at the bore face 200 and characteristics of spall fragments 210 from these optical data, and adjust advance rate, gas flow rate, power, and/or standoff distance, etc. in real-time during operation based on these bore face 200 conditions and spall fragment characteristics.

In one variation of the example implementation, the optical sensor 190 is arranged at the leading edge of the chassis 110 as seen in FIG. 5. However, the optical sensor 190 can be arranged at any other location on the chassis 110. Additionally, or alternatively, the optical sensor 190 can include a set of optical sensors arranged in a planar or non-planar array along one or more surfaces of the chassis no such that images captured by the set of optical sensors can be processed into three dimensional images of the bore face 200 and/or tunnel by the controller 180.

3.2 Torch Ram

In one implementation, the system 100 includes a plasma torch ram 170 arranged on the chassis 110 and coupled to the plasma torch 132. As depicted in FIGS. 4A and 4B, the plasma torch ram 170 can be configured to: locate the plasma torch 132 on the chassis 110; advance and retract the plasma torch 132 along the chassis 110 along a longitudinal axis substantially parallel to a first direction and a second direction; tilt the plasma torch 132 along a pitch angle relative to the longitudinal axis and a yaw angle relative to the longitudinal axis; lift the plasma torch 132 vertically along a vertical axis substantially perpendicular to the longitudinal axis; and shift the plasma torch 132 laterally along a horizontal axis substantially perpendicular to the longitudinal axis and the vertical axis.

In this variation of the example implementation, the system 100 can also include a depth sensor and implement methods and techniques described below to regularly or intermittently measure a distance from the plasma torch 132 to the bore face 200 in order to maintain efficient spallation at the bore face 200. The controller 180 can then be configured to: access a target standoff distance between the plasma torch 132 and the bore face 200; and advance the plasma torch ram 170 and/or the propulsion system 120 forward toward the target standoff distance at the bore face 200. As shown in FIG. 4B, the controller 180 can also tilt (e.g., pitch, yaw) the plasma torch ram 170 in a direction toward the bore face 200, such as by an angular distance proportional to a difference between the shortest standoff distance 300 and longest standoff distance 302.

4. Boring Initialization

To initiate a boring operation, the system 100 is located at a bore entry. For example, for a horizontal boring operation, a ground opening (or "launch shaft") is dug (e.g., manually) at a start depth of the bore and at a width and length sufficient to accommodate the system 100 in a horizontal orientation. With the system 100 location in the bore entry and the torch adjacent a bore face 200, the controller 180 can activate the torch by ramping the torch to a baseline power setting and to a baseline gas flow rate, thereby heating the adjacent bore face 200 and initiating spallation and removal of material from the bore face 200.

During the initial boring operation, the controller 180 can be configured to: actuate the propulsion system 120 to advance the chassis 110 toward the ground opening at an initial standoff distance; actuate the plasma torch 132 to remove material from the bore face 200; trigger the optical sensor 190 to capture a set of images at the bore face 200; isolate intransient features in the set of images; and derive a temperature profile based on pixel intensities of the intransient features. The controller 180 is further configured to: access a target bore face shape for the cross section of the bore face 200 being created, which in one example may be provided as a substantially D-shape profile; and direct the plasma torch ram 170 to adjust the orientation of the plasma torch 132 (e.g., pitch angle and the yaw angle) to spallate the bore face 200 consistent with the target bore face shape.

5. Bore Face Temperature Monitoring: Intransient Image Features

Once located in the bore and activated, the system 100 can: execute imaging cycles; detect and track temperatures, temperature profiles, and/or molten areas of the bore face 200 based on intransient features (e.g., features exhibiting significant change over relatively long time scales, such as greater than one second) detected in images captured by the optical sensor 190; and then adjust actuators and operating parameters based on these features to maintain or increase material removal rate from the bore.

5.1 High-Temperature Thermal Imager

In another variation of the example implementation, the optical sensor 190 includes a high-temperature thermal imager—such as a short-wave infrared camera—configured to capture a thermal image of the bore face 200. The controller 180 can thus: target rate or frequency (e.g., greater than 100 Hz); compare these sequential images to detect transient (e.g., moving) features in these images; isolate intransient regions in these images; and then derive temperature profiles of the bore face 200 based on pixel intensities in intransient regions in these thermal images.

5.2 Saturation-Based Bore Face Temperature Tracking

Alternatively, the controller 180 can track temperatures across the bore face 200 based on saturation of pixels in images captured by the optical sensor 190.

5.2.1 Temperature Calibration from Shutter Speed

In one implementation, the system 100 includes a fixed lens shade 192 in the field of view of the optical sensor 190, such as including an interference coating characterized by a frequency response spanning a range of wavelengths of electromagnetic radiation emitted by various geologies when heated to their melting temperatures. Accordingly, the controller 180 can: modulate a shutter speed (e.g., imaging duration) of the optical sensor 190 to achieve a target or minimum saturation of pixels in an image captured by the optical sensor 190; and then interpret a temperature of the bore face 200 and/or detect molten regions on the bore face 200 based on pixel intensities in this image and the shutter speed of the optical sensor 190 when this image was captured.

In this implementation, the controller 180 can: set the optical sensor 190 to a first shutter speed; trigger the optical sensor 190 to capture a first image; scan the first image for saturated pixel clusters; and compare saturated pixel clusters in this first image to saturated pixel clusters in preceding images to identify and filter (e.g., remove, discard, ignore) short-time domain saturated pixel clusters—which may represent spall and other particulate moving through the working field—from the current image. In one variation of this implementation, the system 100 can implement machine learning techniques to identify the saturated pixel clusters. The controller 180 can then implement closed-loop controls: to increase the shutter speed of the optical sensor 190 if the size or count of saturated pixel clusters in the image exceeds a high threshold (e.g., more than 2% of the image); and to decrease the shutter speed of the optical sensor 190 if the size or count of saturated pixel clusters in the image is less than a low threshold (e.g., less than 1% of the image). The controller 180 can then trigger the optical sensor 190 to capture a next image and repeat this process to adjust the shutter speed of the optical sensor 190 until the controller 180 identifies an image containing a proportion of saturated pixels between the low and high thresholds.

The controller 180 can then: calibrate a temperature conversion model for converting pixel intensities into temperatures of corresponding regions on the bore face 200 based on the shutter speed that yielded this target proportion of saturated pixels in this last recorded image; and interpret a temperature profile across the bore face 200 based on pixel intensities in this last recorded image and the calibrated temperature conversion model.

5.2.2 Temperature from Lens Shade Setting

In another implementation, the lens shade 192 is adjustable. For example, the lens shade 192 can include: a set (e.g., a pair) of perpendicular polarization filters; and a liquid crystal cell (or "LCD") panel interposed between the set of perpendicular polarization filters. In this implementation, the controller 180 can: dynamically adjust the lens shade 192 in order to control saturation of pixels in images captured by the optical sensor 190; and derive a temperature profile of the bore face 200 based on pixel intensities in an image captured by the optical sensor 190 and a setting of the lens shade 192 when this image was captured.

For example, during operation, the controller 180 can: apply a first voltage across the LCD panel to steer incident light—passed by a first polarization filter in the lens shade 192—by a first degree in a direction non-parallel to a second polarization filter in the set; trigger the optical sensor 190 to capture a first image; scan the first image for saturated pixel clusters; and compare saturated pixel clusters in this first image to saturated pixel clusters in preceding images to identify and filter short-time domain saturated pixel clusters from the current image. The controller 180 can then implement closed-loop controls: to increase the position of (e.g., the voltage across) the LCD panel and thus increase filtering of inbound radiation if the size or count of saturated pixel clusters in the image exceeds a high threshold (e.g., more than 2% of the image); and to decrease the position of the LCD panel and thus decrease filtering of inbound radiation if the size or count of saturated pixel clusters in the image is less than a low threshold (e.g., less than 1% of the image). The controller 180 can then trigger the optical sensor 190 to capture a next image and repeat this process to adjust the position of the lens shade 192 until the controller 180 identifies an image containing a proportion of saturated pixels between the low and high thresholds.

The controller 180 can then: calibrate a temperature conversion model for converting pixel intensities into temperatures of corresponding regions on the bore face 200 based on the shutter speed that yielded this target proportion of saturated pixels in this last recorded image; and interpret a temperature profile across the bore face 200 based on pixel intensities in this last recorded image and the calibrated temperature conversion model.

5.2.3 Hot Zones

In another implementation, the controller 180 can: trigger the optical sensor 190 to capture an image; implement methods and techniques described above to isolate long-time-domain regions in the image; scan these long-time-domain regions in the image for clusters of saturated pixels; and interpret "hot zones" (e.g., molten regions) on the bore face 200 at locations corresponding to these clusters of saturated pixels.

The controller 180 can also estimate a minimum temperature in these hot zones 220 based on a shutter speed of the optical sensor 190 and/or a lens shade position when the image was captured, such as described above.

5.2.4 Temperature Topology Map

In the foregoing implementation, the system 100 can also: capture a series of images over a range of shutter speeds and/or lens shade positions; implement the foregoing process to identify hot zones 220 on the bore face 200 based on saturated pixel clusters in each image; estimate a minimum temperature represented by saturated pixel clusters in each image based on shutter speed and/or lens shade position when these images were captured; and then overlay the locations, areas, and minimum temperatures of these hot zones 220—derived from this series of images—into a temperature profile (e.g., a "temperature topology map") of the bore face 200.

5.3 Bore Face Temperature Controls

The controller 180 can then modulate standoff distance, power, and gas flow rate based on the temperature profile of the bore.

In one implementation, if the temperature profile at the bore face 200—derived from a last image captured by the optical sensor 190—indicates a high temperature at the perimeter of the bore face 200 (e.g., a temperature in excess of a target bore perimeter temperature or less than a target temperature difference from the temperature of the center of the bore face 200) and a lower temperature near the center of bore face 200 (e.g., a temperature less than a target bore center temperature or less than a target temperature difference from the temperature of the perimeter of the bore face 200), the controller 180 can decrease the standoff distance and maintain the current power and gas flow settings for the plasma torch 132 in order to direct more energy and pressure to the center of the bore face 200. Conversely, if the temperature profile at the bore face 200 indicates a low temperature near the perimeter of the bore face 200 and a target temperature range near the center of the bore face 200, the controller 180 can increase the standoff distance and increase power and gas flow rate in order to direct more energy to the center perimeter of the bore face 200 while maintaining energy and pressure at the center of the bore face 200. Furthermore, if the temperature profile at the bore face 200 indicates a low temperature at both the perimeter and the center of bore face 200, the computer system can decrease the standoff distance and increase power and gas flow rate in order to direct more energy and pressure across the bore face 200. Similarly, if the temperature profile at the bore face 200 indicates a high temperature at both the perimeter and the center of bore face 200, the computer system can increase the standoff distance and decrease power and gas flow rate in order to direct less energy and pressure across the bore face 200.

For example, in the foregoing implementation, the controller 180 can compare the current temperature profile across the bore face 200 to a target temperature gradient from the center of the bore face 200 to the perimeter of the bore face 200 and then implement closed-loop controls to modulate power, gas flow rate, and standoff distance in order to achieve this target temperature gradient across the bore face 200.

5.4 Controls: Plasma Torch Orientation

In another implementation, the control adjusts the pitch and yaw position of the plasma torch 132—via the torch ram—to preferentially direct energy and pressure to low-temperature regions on the bore face 200.

In one example, the controller 180: scans the temperature profile of the bore face 200—derived from the last image captured by the optical sensor 190—for a low-temperature region exhibiting a greatest deviation from a target temperature or target temperature gradient; adjusts the pitch and yaw of the plasma torch 132 to align the longitudinal axis of the plasma torch 132 with this low-temperature region; (decreases the standoff distance, increases plasma torch 132 power, and/or increases gas flow rate in order to further increase energy and power to this low-temperature region;) triggers the optical sensor 190 to capture a next image of the bore face 200; recalculates a temperature profile of the bore face 200 based on this next image; and verifies improvement in temperature of this low-temperature region. The controller 180 can then repeat this process to detect a next low-temperature region on the bore face 200 and to reorient the plasma torch 132 accordingly.

The controller 180 can implement similar methods and techniques to: scan the temperature profile of the bore face 200—derived from the last image captured by the optical sensor 190—for a high-temperature region exhibiting a greatest deviation from a target temperature or target temperature gradient; adjust the pitch and yaw of the plasma torch 132 to move the longitudinal axis of the plasma torch 132 away from this high-temperature region; (increase the standoff distance, decrease plasma torch 132 power, and/or decrease gas flow rate in order to further decrease energy and power to this high-temperature region;) trigger the optical sensor 190 to capture a next image of the bore face 200; recalculate a temperature profile of the bore face 200 based on this next image; and verify improvement in temperature of this high-temperature region. The controller 180 can then repeat this process to detect a next high-temperature region on the bore face 200 and to reorient the plasma torch 132 accordingly.

5.5 Controls: Thermally-Shielded Window

In another variation of the example implementation, the optical sensor 190 includes: a lens shade 192—such as a fixed or adjustable UV, infrared, and/or visible light filter—arranged across the field of view of the optical sensor 190; and a thermally-shielded window 194 (e.g., a louvered shutter) arranged across the field of view of the optical sensor 190.

In this variation of the example implementation, the controller 180 can trigger an imaging cycle, during which the controller 180 can be configured to: actuate the thermally-shielded window 194 to entirely or partially expose the lens shade 192 in response to the imaging cycle being initiated; trigger the optical sensor 190 to capture a first set of images of the bore face 200; detect transient features in the first set of images; isolate intransient regions of the first set of images based on pixel intensities; generate a temperature profile based on the intransient regions; and detect a first set of spall fragments 210 at the bore face 200 based on the temperature profile.

In this variation of the example implementation, the controller 180 can be further configured to: access a temperature limit for the optical sensor 190; detect a temperature for the optical sensor 190 in response to the imaging cycle being initiated; and compare the temperature for the optical sensor 190 against the temperature limit for the optical sensor 190 in order to protect the optical sensor 190 from being exposed to high temperatures that may render the optical sensor 190 inoperable.

In another variation of the example implementation, in response to the temperature limit for the optical sensor 190 exceeding the temperature limit for the optical sensor 190, the controller 180 can be configured to: terminate the imaging cycle; actuate the thermally-shielded window 194 to entirely or partially cover the lens shade 192; initiate a standby period for the optical sensor 190; and detect a temperature reading for the optical sensor 190 at regular intervals during the standby period. Additionally, the controller 180 can then initiate the imaging cycle once again in response to the temperature reading for the optical sensor 190 falling below the temperature limit during the standby period.

In another implementation, the controller 180 can be configured to actuate the thermally-shielded window 194 to partially or entirely cover the optical sensor 190 at an oscillation frequency (e.g., 30 Hz) during an imaging cycle to protect the optical sensor 190 from flying debris and spallation at the bore face 200.

In this variation of the example implementation, the controller 180 can be configured to: initiate an imaging cycle at a first time to capture a set of images at the bore face 200; at the first time access an oscillation frequency for the thermally-shielded window 194; and modulate the oscillation of the thermally-shielded window 194 according to the oscillation frequency to shield the optical sensor 190 from flying debris and spallation at the bore face 200 during a portion of the imaging cycle. Furthermore, the controller 180 can be configured to: detect a trigger terminating the imaging cycle; detect a trigger initiating an operating period; and set an oscillation frequency of zero hertz to terminate the modulated oscillation of the thermally-shielded window 194 and set the thermally-shielded window 194 in a closed position.

6. Molten Material Tracking v. Temperature Tracking

Additionally, or alternatively, rather than detect and track a temperature profile of the bore face 200, the controller 180 can: implement similar methods and techniques to detect and track molten area on the bore face 200; and adjust standoff distance, power, and gas flow rate in order to maintain a target area or proportion of molten material across the bore face 200.

For example, rock and other geologies may exhibit significantly greater emissivity when molten than when solid. Therefore, the controller 180 can detect molten regions on the bore face 200 at locations corresponding to saturated pixel clusters in an image captured by the optical sensor 190. The controller 180 can also modulate the shutter speed and/or lens shade position over a sequence of images captured by the optical sensor 190 and verify that a statured pixel cluster in an image corresponds to a molten area on the bore face 200 if the size and location of this statured pixel cluster persists over a range of shutter speeds and/or lens shade positions. Accordingly, the controller 180 can characterize frequency, size, geometry, and/or area proportion of molten regions on the bore face 200 based on statured pixel clusters in images captured by the optical sensor 190.

The controller 180 can then adjust power, gas flow rate, and standoff distance, etc. in order to maintain a target frequency, size, geometry, and/or area proportion of molten regions across the bore face 200 (e.g., 2% or 20% total molten area).

In this variation of the example implementation, the controller 180 can then be configured to: capture a first set of images at the bore face 200; detect transient features in the first set of images; isolate intransient regions in the first set of images; and interpret a temperature profile based on pixel intensities in the intransient regions in the first set of images. The controller 180 can further be configured to detect a first set of spall fragments 210; and detect a hot zone 220 at the bore face 200 based on the temperature profile. In this implementation, the first set of spall fragments 210 represents the material spallated from the bore face 200 and the hot zone 220 can represent a molten region at the bore face 200.

In another variation of the example implementation, the hot zone 220 detected by the optical sensor 190 can include: a hot zone temperature; a hot zone area; and a hot zone location. In this variation of the example implementation, the hot zone temperature can be represented by red and/or infrared frequencies detected in the temperature profile in order to identify the molten region at the bore face 200 that is in direct exposure to the plasma torch 132. Additionally, the hot zone area can represent an area of the molten region at the bore face 200 resulting from exposure to heat and pressure emitted from the plasma torch 132.

As shown in FIG. 3, the hot zone area can be represented as a circular area of the molten region at the bore face 200. In this variation of the example implementation, the controller 180 can be configured to access a target hot zone temperature and a target hot zone area. In response to the hot zone temperature detected at the temperature profile exceeding the target hot zone temperature, the controller 180 can then actuate the plasma torch ram 170 to increase the standoff distance of the plasma torch 132 and/or decrease power and gas/flow rate being supplied to the plasma torch 132. In response to the hot zone area detected at the temperature profile exceeding the target hot zone area, the controller 180 can actuate the plasma torch ram 170 to increase the standoff distance of the plasma torch 132 and/or decrease the power and gas flow rate supplied to the plasma torch 132.

7. Spall Monitoring: Short-Time Domain Temperature Tracking

The controller 180 can additionally or alternatively detect and characterize spall fragments 210 discharged from the bore face 200 and control power, gas flow rate, standoff distance, and the spoil evacuation subsystem based on the spall fragment characteristics.

In particular, the controller 180 can: trigger the optical sensor 190 to capture a series of images; detect transient saturated pixel clusters across this series of images; interpret these transient saturated pixel clusters as spall fragments 210 moving off of the face of the bore; and adjust power, gas flow rate, standoff distance, and/or spoil evacuation subsystem parameters in order to achieve a tight distribution of spall fragments 210 around a target spall size throughout operation of the system 100.

Furthermore, in this variation of the method, the controller 180 is described as detecting transient saturated pixel clusters in a series of images and identifying these transient saturated pixel clusters as depicting spall fragments 210 ejected from the bore face 200. However, the controller 180 can additionally or alternatively detect lower-temperature spall fragments 210 depicted in these images based on color gradients, unsaturated temperature gradients, and/or motion of objects depicted in these images. Similarly, the controller 180 can additionally or alternatively distinguish spall fragments 210 from the bore face 200 in these images based on color gradients, unsaturated temperature gradients, and/or motion of objects over a bore face 200 background depicted in these images.

7.1 Target Spall Size

In one implementation, the controller 180 accesses a target spall size, such as entered manually by an operator and stored in local memory in the system 100 or calculated by the controller 180 based on a detected or predicted geology at the bore face 200.

In one implementation, the target spall size can be specified based on the type and/or density of geologies at the bore face 200. For example, the controller 180 can select a smaller target spall size for higher-density geologies and/or for geologies with higher heat capacities, thereby enabling surface temperature of resulting spall fragments 210 to drop below a threshold temperature within a threshold distance behind the system 100 and thus reducing thermal management and shielding requirements beyond this threshold distance behind the system 100. Accordingly, the controller 180 can also limit a maximum mass of these spall fragments 210, thereby enabling the spoil evacuation subsystem to draw heated spall fragments 210—moving off of the bore face 200—at least a minimum distance behind the system 100 before these spall fragments 210 settle on the base of the tunnel or on another structure in the tunnel (e.g., onto a mechanical conveyor located behind the system 100).

Conversely, the controller 180 can select a larger target spall size for lower-density geologies and/or for geologies with lower heat capacities, thereby: preventing these spall fragments 210 from rapidly condensing and adhering to the system 100 or the wall of the bore; and enabling the system 100 to increase boring rate with less energy consumption per unit bore distance.

Furthermore, by maintaining a tight distribution of spall fragment size, the system 100 may eliminate need for spoil sorting, filtering, crushing, or other post-processing once removed from the tunnel.

7.2 Spall Detection and Characterization

In one implementation, the controller 180 can: trigger the optical sensor 190 to capture a first image; scan the first image for saturated pixel clusters; and compare saturated pixel clusters in this first image to saturated pixel clusters in preceding images to identify and isolate (e.g., extract) moving (e.g., short-time domain) saturated pixel clusters—which may represent spall and other particulate moving through the working field—in the current image.

The controller 180 can then derive spall characteristics for a first time interval corresponding to a first image based on these moving saturated pixel clusters. For example, the controller 180 can estimate a quantity, a maximum size (e.g., width, area), a minimum size, an average size, a size variance, and/or a size distribution (e.g., a histogram) of spall fragments 210 during this first time interval based on the widths, radii, and/or pixel areas of these saturated pixel clusters.

(In one variation, the system 100 includes two laterally-offset optical sensors, and the controller 180: implements 3D reconstruction techniques to merge concurrent images from these two optical sensors into a 3D thermal image; implements similar methods and techniques to detect and isolate moving saturated 3D volumes in the 3D thermal image; then derives spall characteristics for the current time interval based on radii and/or volumes of these moving saturated 3D volumes.)

The controller 180 can repeat this process to derive spall characteristics for subsequent time intervals based on subsequent images captured by the optical sensor(s).

7.3 Spall Controls

The controller 180 can then implement closed-loop controls to adjust power, gas flow rate, and/or standoff distance in order to maintain a target spall fragment size and low spall fragment size variance.

For example, if the average spall fragment size is less than the target spall fragment size, the controller 180 can increase gas flow rate and decrease standoff distance in order to increase pressure at the bore face 200, which may induce greater fracture and spallation of larger spall fragment from the bore face 200. Conversely, if the average spall fragment size is greater than the target spall fragment size, the controller 180 can decrease gas flow rate, increase standoff distance, and increase power in order to decrease pressure and increase energy at bore face 200, which may reduce fracturing and increase melting to create small spall fragments 210.

In another example, if spall fragment size exhibits high variance or a wide size distribution, the controller 180 can: decrease gas flow rate and power in order to decrease energy at the bore face 200; decrease standoff distance in order to focus energy to a smaller region of the bore face 200 and thus reduce size variance of spall fragments 210 ejected from this region of the bore face 200; and sweep (i.e., pitch and/or yaw) the plasma torch 132 across the bore face 200 in order to energize and remove low-variance spall fragments 210 from these regions of the bore face 200. Then, as the size variance of spall fragments 210 decreases over time, the controller 180 can incrementally increase gas flow rate, standoff distance, and power in order to increase removal rate while maintaining low spall fragment size variance around the target spall size.

In another example, if the maximum spall fragment size exceeds the target spall fragment size, the controller 180 can: predict loose geology (e.g., silt, gravel) or a geology with low structural integrity (e.g., fractured limestone) at the bore face 200; and increase gas flow rate, decrease power, and decrease standoff distance in order to increase pressure but reduce energy across the bore face 200, thereby increasing probability of fracturing (or melting) loose geology into smaller fragments. Conversely, if the maximum spall fragment size exceeds the target spall fragment size, the controller 180 can: predict resilient geology (e.g., granite) or geology with high structural integrity (e.g., a boulder); and then decrease gas flow rate, increase power, and increase standoff distance in order to decrease pressure but increase energy across the bore face 200, thereby reducing fracturing and increasing spall size.

7.4 Spall Removal

The controller 180 can also adjust operation of the spoil evacuation subsystem based on characteristics of spall fragments 210 detected in the working volume.

In one variation, the system 100 includes: a negative pressure subsystem configured to draw spall through the tunnel behind the chassis no; and/or a positive pressure subsystem configured to pressurize the working volume between the leading end of the chassis 110 and the bore face 200. For example, the negative pressure subsystem can include a surface-level exhaust coupled to the tunnel or an intra-tunnel exhaust face offset behind the chassis 110 within the tunnel. In another example, the positive pressure subsystem: can include a set of jets or nozzles coupled to a surface-level compressor or pressurized gas tank; and can be configured to release bursts or a continuous stream of pressurized gas ahead of the system 100 in order to discharge spall from the working volume and influence this spall rearward.

In this variation, to prevent collection of spall between the leading end of the chassis no and the bore face 200, the controller 180 can: track sizes of spall fragments 210 ejected from the bore face 200, as described above; and implement closed-loop controls to adjust gas pressure and/or flow rate through the positive pressure subsystem proportional to maximum spall size in order to discharge largest spall fragments 210 from the working volume. For example, the controller 180 can: increase the gas pressure and/or flow rate when the controller 180 detects large spall fragments 210 in order to increase probability that these large spall fragments 210 settle behind the system 100 rather than in the working volume; and decrease the gas pressure and/or flow rate when the controller 180 detects small spall fragments 210 in order to reduce energy consumption and settling distance of these smaller spall fragments 210 behind the system 100.

In another variation, the system 100 can include an additional optical sensor 190 or set of optical sensors 190 arranged on a non-leading edge of the chassis 110, e.g., arranged with a field of view to the side and/or rear of the chassis 110 and configured to image spall fragments passing through the tunnel past the chassis 110. In this variation of the example implementation, the controller 180 can then implement closed loop controls as previously described to determine an average spall size of the spall fragments 210 being directed through the tunnel.

Similarly, in this variation, to control a distance at which spall settles behind the chassis 110, the controller 180 can implement closed-loop controls to adjust negative pressure and/or flow rate through the negative pressure subsystem inversely proportional to maximum spall size in order to maintain a maximum or average settling distance of spall fragments 210 behind the chassis 110. For example, the controller 180 can: increase the negative pressure and/or flow rate when the controller 180 detects large spall fragments in order to assist the positive pressure subsystem in drawing these large spall fragments behind the chassis no; and decrease the gas pressure and/or flow rate when the controller 180 detects small spall fragments in order to reduce the settling distance of these smaller spall fragments behind the system 100.

In another example, if the controller 180 detects a large size variance of spall fragments 210 and a large maximum spall size in the last image captured by the optical sensor 190, the controller 180 can: increase pressure and/or flow rate of the positive pressure subsystem in order to influence large spall fragments rearward and out of the working volume; and decrease pressure and/or flow rate of the negative pressure subsystem in order to prevent smaller spall fragments from settling beyond a maximum distance behind the chassis no. Conversely, if the controller 180 detects a small size variance of spall fragments 210 and a large maximum spall size in the last image captured by the optical sensor 190, the controller 180 can: increase pressure and/or flow rate of the positive pressure subsystem in order to influence large spall fragments rearward and out of the working volume; and increase pressure and/or flow rate of the negative pressure subsystem in order to assist the positive pressure subsystem in drawing these small segments rearward. Furthermore, if the controller 180 detects a small size variance of spall fragments 210 and a small maximum spall size in the last image captured by the optical sensor 190, the controller 180 can decrease pressure and/or flow rate of both the negative and positive pressure subsystems in order to prevent these smaller spall fragments from settling beyond the maximum distance behind the chassis 110

7.5 Spall Speed

In a similar variation, the controller 180: implements object tracking techniques to track an individual spall fragment across consecutive images captured by the optical sensor 190; and derives a speed of this spall fragment based on a time offset between these images, a change in pixel size of the spall fragment across the images, etc.; and then adjusts the negative and positive pressure subsystems in order to maintain this speed at a spall removal target speed (or at a target speed based on the size of the spall fragment).

For example, in order to prevent collection of spall between the leading end of the chassis no and the bore face 200 and/or in order to control a distance at which spall settles behind the chassis 110, the controller 180 can: increase the gas pressure and/or flow rate of the positive pressure subsystem when the controller 180 detects slow-moving spall fragments 210 in order to increase speed of these slow spall and to prevent these spall fragments 210 from settling in front of or on the chassis no; and decrease the gas pressure and/or flow rate of the positive pressure subsystem when the controller 180 detects fast-moving spall fragments 210 in order to decrease speed of these fast spall and to prevent these spall fragments 210 from settling beyond a threshold distance behind the chassis 110.

Furthermore, in this variation, the controller 180 can calculate a target speed for a spall fragment based on (e.g., proportional to) the size of the spall fragment and adjust the negative and/or positive pressure subsystems accordingly in order to prevent settling of larger, slower spall fragments in the working volume and to prevent extended settling distances of smaller spall fragments. For example, the controller 180 can: detect a largest spall fragment in an image captured by the optical sensor 190; estimate an actual speed of this spall fragment, as described above; calculate a target speed of this spall fragment proportional to its size; calculate a difference between the actual and target speeds of the spall fragment; and adjust the flow rate and/or pressure of the positive pressure subsystem proportional to this difference, including increasing the flow rate and/or pressure of the positive pressure subsystem if the actual speed rate is less than the target speed, and vice versa.

7.6 Spall Population Density

In another variation of the example implementation, the controller 180 can: also detect multiple regions at the temperature profile, each containing a set of spall fragments 210; and calculate a population density for the set of spall fragments 210 at each region. In this implementation, regions containing a population density of spall fragments 210 above a predetermined threshold can be targeted to increase efficiency of spall removal. The controller 180 can then implement closed loop controls as described above to target these regions and control spall population density for regions at the bore face 200.

For example, the first set of spall fragments 210 detected by the optical sensor 190 can include: a spall fragment region, an average spall size, and a spall fragment population density. In this example, the spall fragment region represents the location at the bore face 200 containing the first set of spall fragments 210, which can be represented by x and y coordinate locations for the 2D temperature profile constructed by the controller 180. The controller 180 can then calculate an average spall size by: identifying a number N of spall fragments (e.g., spall population density) in the set of spall fragments 210; for each spall fragment in the first set of spall fragments 210, calculating a number of pixels associated with the spall fragment in the image captured by the optical sensor 190; summing the total number of pixels (e.g., total spall pixel count) representing the total spall fragments in the first set of spall fragments 210; and dividing the total spall pixel count by the number N of spall fragments.

In this variation of the example implementation, the controller 180 can be configured to: detect a first set of spall fragments 210 at the bore face 200 based on the temperature profile; define a first region of a predetermined shape (e.g., a circle) at the bore face 200 containing the first set of spall fragments 210; detect a second set of spall fragments 210 at the bore face 200 based on the temperature profile; define a second region of a predetermined shape (e.g., a circle) at the bore face 200 containing the second set of spall fragments 210; calculate a first spall population density of the first set of spall fragments 210 at the first region; and calculate a second spall population density of the second set of spall fragments 210 at the second region.

In this variation of the example implementation, the controller 180 can further be configured to adjust standoff distance and power/gas flow rate of the plasma torch 132 according to the spall population density calculated at the bore face 200. For example, the controller 180 can: access a target spall density population for the bore face 200 based on geologies detected or predicted at the bore face 200; compare the first spall population density for the first region with the target spall density population; and compare the second spall population density for the second region with the target spall density population. For example, in response to the first spall population density exceeding the target spall population density, the controller 180 can: actuate the plasma torch ram 170 to adjust the pitch angle and the yaw angle of the plasma torch 132 from a starting position to a first adjusted position to direct the plasma torch 132 toward the first region at the bore face 200; actuate the propulsion system 120 to modify the standoff position from a first standoff distance to a second standoff distance in agreement with the first adjusted position; and increase power and gas flow rate to the plasma torch 132 to achieve the target spall population density for the first region density based on geologies detected or predicted for the first region at the bore face 200.

Furthermore, in response to the second spall population density for the second region falling below the target spall population density, the controller 180 can: actuate the plasma torch ram 170 to adjust the pitch angle and the yaw angle of the plasma torch 132 from the first adjusted position to the starting position; and actuate the propulsion system 120 to modify the standoff distance from the second standoff distance to the first standoff distance.

The controller 180 can implement the foregoing methods and techniques in response to deviations between the target spall population density with the second (third, fourth, etc.) region.

8. Variations

In another variation of the example implementation, the system 100 can include ground penetrating radar to detect and predict geology profiles for multiple layers at the bore face 200. Additionally, or alternatively, the system 100 can also include a bore face temperature control subsystem to aid in cooling the bore face 200.

8.1 Predictive Geological Profiles

In one variation of the example implementation, the system 100 can include a ground penetrating radar directed toward the bore face 200. The controller 180 can be configured to trigger the ground penetrating radar to: emit a first signal directed at the bore face 200; and receive a second signal reflected from the bore face 200. Additionally, the controller 180 can be configured to: interpret the first signal and the second signal to generate a geology profile of the bore face 200; identify a first layer in the geology profile representing a first region of the bore face 200 proximally exposed to the plasma torch 132; generate a first predictive geology model for the first layer; identify a second layer in the geology profile representing a second region of the bore face 200 located behind the first layer, and embedded within the bore face 200; and generate a second predictive geology model for the second layer.

In one example of this implementation, the controller 180, at a first time, can be configured to: actuate the plasma torch ram 170 to adjust the pitch angle and yaw angle of the plasma torch 132 with respect to the bore face 200, according to the first predictive geology model for the first layer; and adjust power and gas flow rate to the plasma torch 132 according to the first predictive geology model for the first layer. Furthermore, the controller 180, at a second time, following the first time, can be configured to: actuate the plasma torch ram 170 to adjust the pitch angle and yaw angle of the plasma torch 132, according to the second predictive geology model for the second layer; and adjust power and gas flow rate to the plasma torch 132 according to the second predictive geology model for the second layer.

In another variation of the example implementation, the system 100 can include a ground-penetrating radar and an optical sensor 190 directed toward the bore face 200. The controller 180 can then implement closed loop controls for the ground penetrating radar and the optical sensor 190 in parallel or in series, to adjust pitch angle, yaw angle, power, and gas flow rate for the plasma torch 132 according to temperature profiles and geology profiles in order to efficiently spallate the bore face 200.

8.2 External Temperature Control Subsystems

In another variation of the example implementation, the system 100 can also include an external temperature control subsystem arranged on the chassis no and directed toward the bore face 200.

In this variation of the example implementation, the controller 180 can be configured to: trigger the optical sensor 190 to capture a set of images at the bore face 200; detect transient regions in the set of images; isolate intransient features based on pixel intensities in the first set of images; interpret a temperature profile based on intensities of intransient pixels in the first set of images; and detect a of molten region at the bore face 200 based on the temperature. The controller 180 can then access a target temperature for the molten region at the bore face 200. In response to the temperature of the molten region exceeding the target temperature, the controller 180 can: actuate the plasma torch ram 170 to increase the standoff distance between the plasma torch 132 and the bore face 200; decrease power and gas flow rate being supplied to the plasma torch 132 to engage the plasma torch 132 into an off-state; and actuate the external temperature control subsystem to deliver cooling fluid and/or gas to the bore face 200 in order to cool the molten region to achieve the target temperature.

8.3 Air Density Detection

In another variation of the example implementation, the system 100 can also include an air quality sensor configured to ingest and qualify and/or quantify ejected spall fragments. The controller 180 can be configured to trigger the air quality sensor to: sample an air quality in a region proximal to the system 100, and identify a density of dust particles in the region. The controller 180 can then be configured to: correlate the density of dust particles in the region with the average of spall size for the first temperature profile. For example, the air quality sensor can include a fine particulate matter sensor (e.g., PM 2.5) arranged with the controller 180 to autonomously or semi-autonomously ingest particulate ejected from the bore face 200 and transmit a signal to the controller 180 regarding a size, shape, and/or characteristic of the ejected spall.

The systems and methods described herein can be embodied and/or implemented at least in part as a machine configured to receive a computer-readable medium storing computer-readable instructions. The instructions can be executed by computer-executable components integrated with the application, applet, host, server, network, website, communication service, communication interface, hardware/firmware/software elements of a user computer or mobile device, wristband, smartphone, or any suitable combination thereof. Other systems and methods of the embodiment can be embodied and/or implemented at least in part as a machine configured to receive a computer-readable medium storing computer-readable instructions. The instructions can be executed by computer-executable components integrated by computer-executable components integrated with apparatuses and networks of the type described above. The computer-readable medium can be stored on any suitable computer readable media such as RAMs, ROMs, flash memory, EEPROMs, optical devices (CD or DVD), hard drives, floppy drives, or any suitable device. The computer-executable component can be a processor but any suitable dedicated hardware device can (alternatively or additionally) execute the instructions.

As a person skilled in the art will recognize from the previous detailed description and from the figures and claims, modifications and changes can be made to the embodiments of the invention without departing from the scope of this invention as defined in the following claims.

We claim:

1. A system for boring with plasma, the system comprising:

a chassis;

a propulsion system connected to the chassis and configured to advance the chassis at a target standoff distance from a bore face;

a plasma torch ram coupled with the propulsion system and configured to adjust the target standoff distance from the bore face;

a plasma torch coupled to the plasma torch ram, wherein the plasma torch ram is configured to perform:

advance and retract the plasma torch along the chassis along a longitudinal axis;

tilt the plasma torch along a pitch angle relative to the longitudinal axis and a yaw angle relative to the longitudinal axis;

lift the plasma torch vertically along a vertical axis perpendicular to the longitudinal axis; and shift the plasma torch laterally along a horizontal axis perpendicular to the longitudinal axis and the vertical axis;

an optical sensor connected to the chassis and facing the bore face; and a controller coupled to the propulsion system, the plasma torch ram, the plasma torch, and the optical sensor, wherein the controller is configured to:

modify the pitch angle and the yaw angle of the plasma torch in accordance with the target standoff distance in response to an area of molten material exceeding a target area;

drive the plasma torch, facing the bore face, to the target standoff distance from the bore face;

actuate the plasma torch to remove material from the bore face at a target temperature;

access an optical image of the bore face at a first shutter speed and a first lens shade position;

detect intransient pixels in the optical image based on pixel intensities in a preceding image;

interpret a temperature profile across the bore face based on intensities of intransient pixels in the optical image, the first shutter speed, and the first lens shade position;

detect the area of molten material at the bore face based on the temperature profile;

increase a standoff distance between the plasma torch and the bore face in response to the area of molten material exceeding the target area; and increase a power of the plasma torch in response to the area of molten material falling below the target area.

2. The system for boring with plasma of claim 1, wherein the controller is further configured to:

access a target spall size;

detect a set of spall fragments at the bore face based on the temperature profile;

calculate an average spall size for the set of spall fragments;

decrease the standoff distance between the plasma torch and the bore face in response to the average spall size exceeding the target spall size; and increase the power of the plasma torch in response to the average spall size falling below the target spall size.

3. The system for boring with plasma of claim 1:

wherein the optical sensor comprises a thermal imager; and wherein the controller is further configured to:

trigger the optical sensor to capture a first set of thermal images of the bore face;

detect transient features in the first set of thermal images;

separate intransient regions in the first set of thermal images; and interpret the temperature profile based on pixel intensities of the intransient regions in the first set of thermal images.

4. The system for boring with plasma of claim 3, wherein the controller is further configured to:

define a first region at the bore face based on the temperature profile;

detect a region temperature of the first region;

access a target region temperature for the first region;

increase the standoff distance between the plasma torch and the bore face in response to the region temperature exceeding the target region temperature; and decrease power of the plasma torch in response to the region temperature exceeding the target region temperature.

5. The system of claim 1, wherein the controller is further configured to:

detect an area of spall fragments at the bore face based on the temperature profile;

access a target density population for the area of spall fragments;

interpret a first set of spall fragments within the area of spall fragments;

define a boundary in the temperature profile containing the first set of spall fragments;

calculate a first density of spall fragments within the first set of spall fragments; and verify that the first density of spall fragments exceeds the target density population.

6. The system for boring with plasma of claim 5, wherein the controller is further configured to:

access a target density population threshold;

decrease the standoff distance between the plasma torch and the bore face in response to the first density of spall fragments exceeding the target density population threshold; and increase the power of the plasma torch in response to the first density of spall fragments exceeding the target density population threshold.

7. The system of claim 1, wherein the controller is further configured to:

detect a set of spall fragments at the bore face based on the temperature profile;

detect a maximum spall size in the set of spall fragments;

detect a minimum spall size in the set of spall fragments;

calculate an average spall size according to the maximum spall size and the minimum spall size in the set of spall fragments;

determine a first variance for the set of spall fragments;

access a maximum variance;

access a target spall size for the set of spall fragments;

decrease the standoff distance between the plasma torch and the bore face in response to the first variance exceeding the maximum variance and the average spall size exceeding the target spall size; and increase the power of the plasma torch in response to the first variance exceeding the maximum variance and the average spall size exceeding the target spall size.

8. The system of claim 1:

wherein the optical sensor comprises:

a lens positioned across a field of view for the optical sensor; and a shielded window configured to selectively cover the lens; and wherein the controller is further configured to:

actuate the shielded window to entirely expose the lens;

modulate the first shutter speed of the optical sensor according to a target saturation of pixels;

interpret the temperature profile across the bore face in response to achieving the target saturation of pixels; and actuate the shielded window to entirely cover the lens in response to increasing power to the plasma torch.

9. The system of claim 1:

wherein the optical sensor comprises a fixed lens shade: in a field of view of the optical sensor; and comprising an interference coating characterized by a frequency response spanning a range of wavelengths of electromagnetic radiation; and wherein the controller is further configured to:

set a shutter speed threshold for the optical sensor;

access a target proportion of saturated pixels;

trigger the optical sensor to capture a first set of images;

compare saturated pixel clusters in a first image to saturated pixel clusters in preceding images;

identify short-time domain saturated pixel clusters representing a set of spall fragments;

detect a proportion of saturated pixels in the first set of images; and modify the first shutter speed to a second shutter speed in agreement with the shutter speed threshold, and in response to the proportion of saturated pixels deviating from the target proportion of saturated pixels.

10. The system for boring with plasma of claim 1, wherein the optical sensor comprises one or more of an infrared thermal camera, a color camera, an array of infrared sensors, and an array of laser single-point temperature sensors.

11. The system for boring with plasma of claim 1, further comprises a light source configured to illuminate the bore face thereby improving visualization of the optical sensor.

12. A method for boring with plasma, the method comprising:

by a controller, at a first time, driving a plasma torch, facing a bore face, to a target standoff distance from the bore face;

by the controller, actuating the plasma torch to remove material from the bore face;

by the controller, accessing an optical image of the bore face at a first shutter speed and a first lens shade position;

by the controller, detecting intransient pixels in the image based on pixel intensities in a preceding image;

by the controller, interpreting a temperature profile across the bore face based on intensities of intransient pixels in the optical image, the first shutter speed, and the first lens shade position;

by the controller, detecting an area of molten material at the bore face based on the temperature profile;

by the controller, in response to the area of molten material exceeding a target area, increasing a standoff distance between the plasma torch and the bore face;

by the controller, in response to the area of molten material falling below the target area, increasing a power of the plasma torch;

by the controller, actuating a plasma torch ram to extend the plasma torch along a longitudinal axis;

by the controller, actuating the plasma torch ram to retract the plasma torch along the longitudinal axis;

by the controller, actuating the plasma torch ram to tilt the plasma torch along a pitch angle and yaw angle relative to the longitudinal axis;

by the controller, actuating the plasma torch ram to lift the plasma torch along a vertical axis perpendicular to the longitudinal axis;

by the controller, actuating the plasma torch ram to shift the plasma torch along a horizontal axis; and by the controller, in response to the area of molten material exceeding the target area, modifying the pitch angle and the yaw angle of the plasma torch in accordance with the standoff distance.

13. The method of claim 12, further comprising:

by the controller, detecting a set of spall fragments at the bore face based on the temperature profile;

by the controller, accessing a target spall size;

by the controller, calculating an average spall size for the set of spall fragments;

by the controller, decreasing the standoff distance between the plasma torch and the bore face in response to the average spall size exceeding the target spall size; and by the controller, increasing the power of the plasma torch in response to the average spall size exceeding the target spall size.

14. The method of claim 12, further comprising:

by the controller, triggering an optical sensor to capture a first set of thermal images of the bore face;

by the controller, detecting transient features in the first set of thermal images;

by the controller, separating intransient regions in the first set of thermal images; and by the controller, interpreting a first temperature profile of the bore face based on pixel intensities of the intransient regions in the first set of thermal images.

15. The method of claim 14, comprising:

by the controller, defining a first region at the bore face based on the temperature profile;

by the controller, detecting a region temperature of the first region;

by the controller, accessing a target region temperature for the first region;

by the controller, increasing the standoff distance between the plasma torch and the bore face in response to the region temperature exceeding the target region temperature; and by the controller, decreasing the power of the plasma torch in response to the region temperature exceeding the target region.

16. The method of claim 12, further comprising:

by the controller, detecting an area of spall fragments at the bore face based on the temperature profile;

by the controller, accessing a target density population for the area of spall fragments;

by the controller, interpreting a first set of spall fragments within the area of spall fragments;

by the controller, defining a boundary in the temperature profile containing the first set of spall fragments;

by the controller, calculating a first density of spall fragments within the first set of spall fragments; and by the controller, verifying the first density of spall fragments exceeds the target density population.

17. The method of claim 16, further comprising:

by the controller, accessing a target density population threshold;

by the controller, decreasing the standoff distance between the plasma torch and the bore face in response to the first density of spall fragments exceeding the target density population threshold; and by the controller, increasing the power of the plasma torch in response to the first density of spall fragments exceeding the target density population threshold.

18. The method of claim 12, further comprising:

by the controller, detecting a set of spall fragments at the bore face based on the temperature profile;

by the controller, detecting a maximum spall size in the set of spall fragments;

by the controller, detecting a minimum spall size in the set of spall fragments;

by the controller, calculating an average spall size according to the maximum spall size and the minimum spall size in the set of spall fragments;

by the controller, determining a first variance for the set of spall fragments;

by the controller, accessing a maximum variance;

by the controller, accessing a target spall size for the set of spall fragments;

by the controller, decreasing the standoff distance between the plasma torch and the bore face in response to the first variance exceeding the maximum variance and the average spall size exceeding the target spall size; and by the controller, increasing the power of the plasma torch in response to the first variance exceeding the maximum variance and the average spall size exceeding the target spall size.

19. The method of claim 12, further comprising:

by the controller, actuating a shielded window to entirely expose an optical sensor;

by the controller, modulating a first shutter speed of the optical sensor according to a target saturation of pixels;

by the controller, in response to achieving the target saturation of pixels, interpreting the temperature profile across the bore face; and by the controller, actuating the shielded window to entirely cover a lens in response to increasing power to the plasma torch.

20. The method of claim 12, further comprising:

by the controller, setting a shutter speed threshold for an optical sensor;

by the controller, accessing a target proportion of saturated pixels;

by the controller, triggering the optical sensor to capture a first set of images;

by the controller, comparing saturated pixel clusters in the first image to saturated pixel clusters in preceding images;

by the controller, identifying short-time domain saturated pixel clusters representing a first set of spall fragments; and by the controller, in response to the proportion of saturated pixels for the first set of images deviating from the target proportion of saturated pixels, modifying the first shutter speed to a second shutter speed in agreement with the shutter speed threshold.

* * * * *